US005605572A

United States Patent [19]

Berger

[11] Patent Number: 5,605,572

[45] Date of Patent: Feb. 25, 1997

[54] GLUE APPLICATOR SYSTEM

[76] Inventor: David B. Berger, 631 Conacher Drive, Willowdale, Ontario, Canada, M2M 3N2

[21] Appl. No.: 398,097

[22] Filed: Mar. 3, 1995

[51] Int. Cl.[6] ..... B05C 17/00

[52] U.S. Cl. ..... 118/241; 118/242; 118/256; 401/48

[58] Field of Search ..... 118/241, 242, 118/256, 264; 156/578; 401/48

[56] References Cited

U.S. PATENT DOCUMENTS

| | | | |
|---|---|---|---|
| 807,887 | 12/1905 | Walker . | |
| 1,192,686 | 7/1916 | Rieger . | |
| 3,545,403 | 12/1970 | Beers | 118/264 |
| 4,180,430 | 12/1979 | Gelman | 118/267 |
| 4,387,002 | 6/1983 | Knecht | 156/578 |
| 4,442,791 | 4/1984 | Adachi et al. . | |
| 4,962,721 | 10/1990 | Peek . | |
| 5,012,758 | 5/1991 | Künzler . | |
| 5,024,180 | 6/1991 | Roman . | |
| 5,078,527 | 1/1992 | Bell . | |

*Primary Examiner*—Laura Edwards

[57] ABSTRACT

An adherent applicator system utilizes a glue stick or other commercially available containerized applicator as a source of fluent adhering agent. In the case of treating items such as envelopes that are pre-glued, the present system may utilize water in the applicator, to become the adhering agent. In addition to the adhering agent container, the system includes container mounting provisions for securing the container/applicator of the adhering agent; media guide provisions for guiding the paper or other media past the active face of the glue stick or other adhering agent applicator, an anvil providing a reactive working surface to generate contact pressure between the media and the applicator face, and applicator adjustment provisions to compensate for wear in the system. The system may include guide provisions, including a roller element guide embodiment, for positioning the applicator relative to the surface of the media being treated. An automatic cap remover is also one option, for removing the protective cap of the fluent agent container, preparatory to applying the agent. Different styles of actuator are provided, including lateral path adjustment provisions to facilitate negotiating planar corners of the media being treated.

20 Claims, 5 Drawing Sheets

FIG.8.
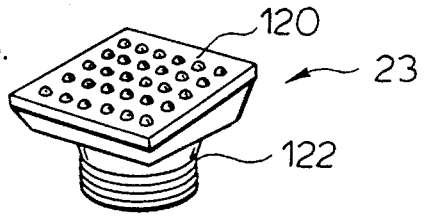
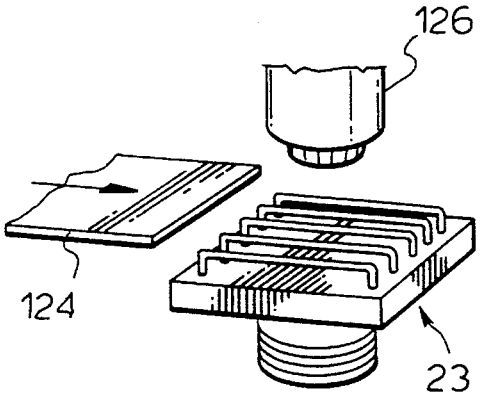
FIG.9.
FIG.10.
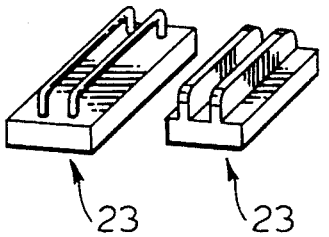
FIG.11.
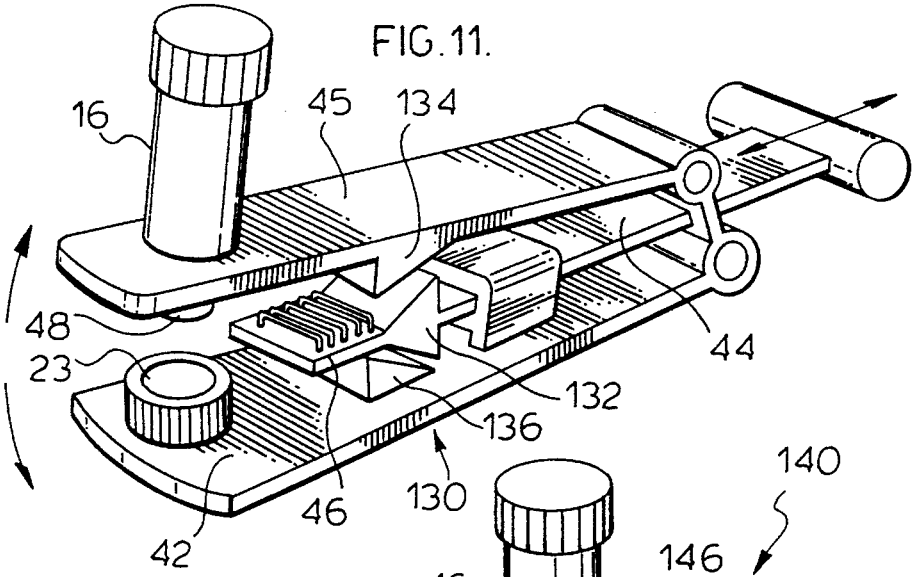
FIG.12.
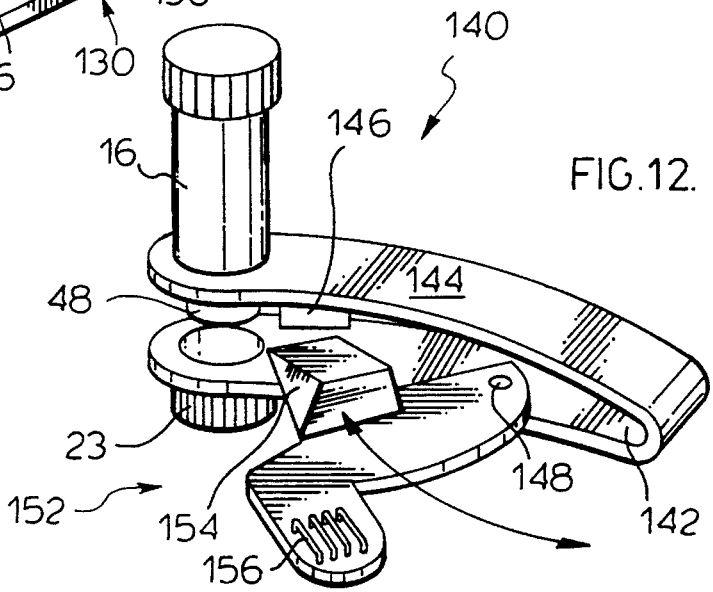

FIG. 13.
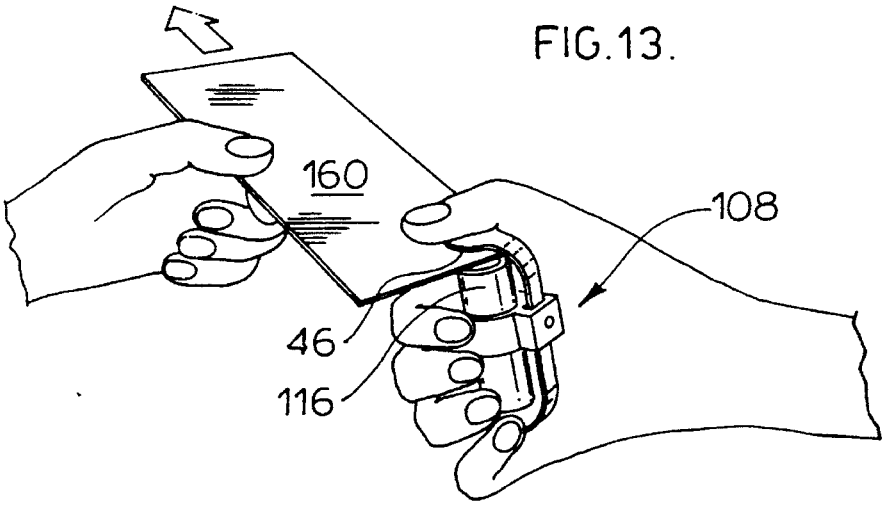
FIG. 14.
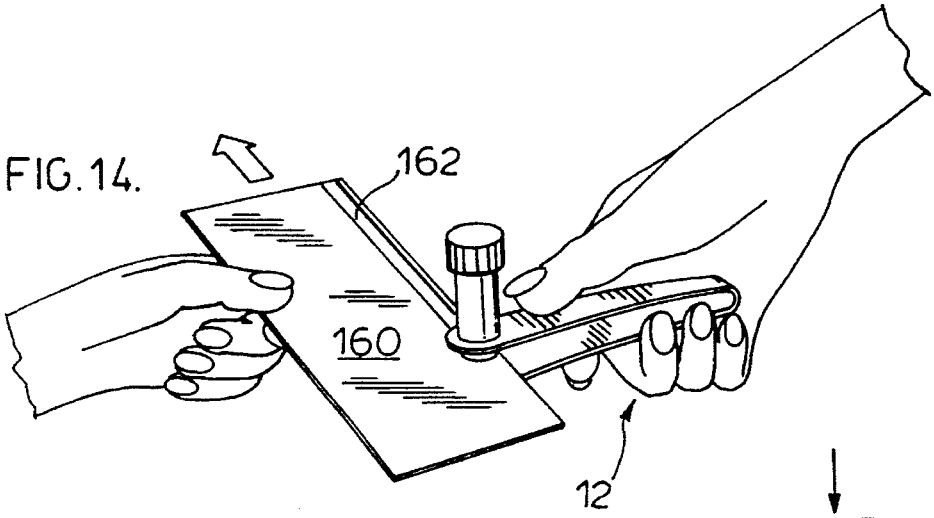
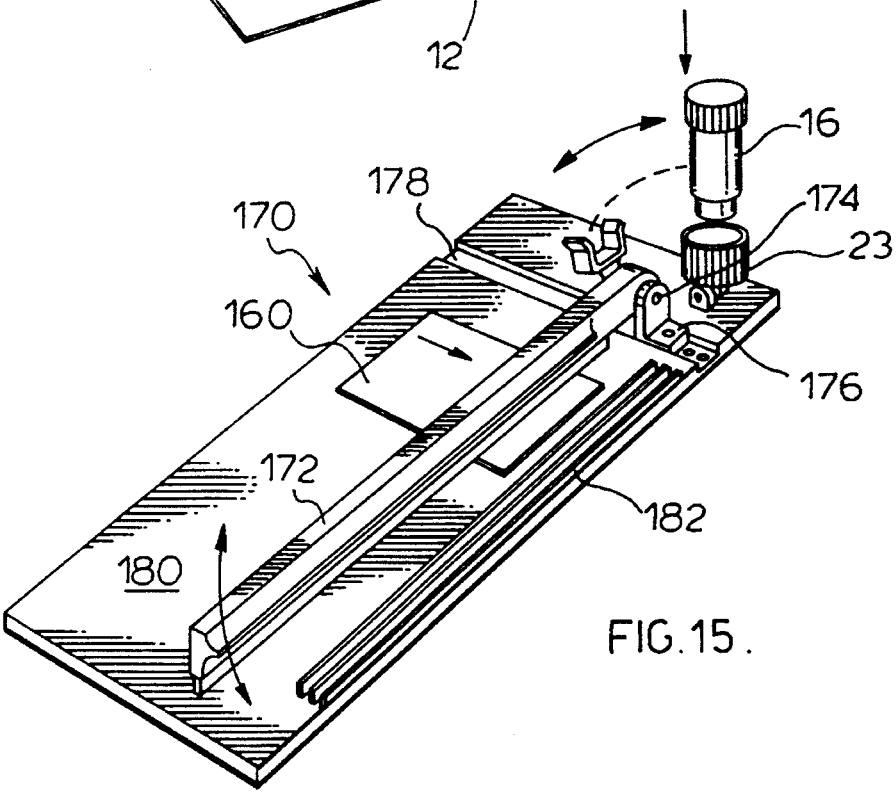
FIG. 15.

GLUE APPLICATOR SYSTEM

FIELD OF THE INVENTION

This invention is directed to an applicator system for applying a fluent agent to a surface being made adhesive, and in particular to a system utilizing a containerized adherant such as glue or a glue stick.

BACKGROUND TO THE INVENTION

The use of glue appears to have diminished in recent years. One phenomenon, the advent of the "hasty note" pad of self adhering leaves that removably adhere through pressure contact to paper and many other surfaces, has greatly reduced the incentive to use a glue adhesive for that general purpose.

Perhaps more importantly, while glue per se is readily available in convenient-to-use glue sticks within a capped, protective dispenser casing, and other, readily dispensed liquid forms, such use is impeded by an absence of ancillary applying means, to facilitate and systematize the application of glue and other fluent adherents to the medium being glued, such as paper, card, etc.

In referring to the adhering of pre-glued envelopes, the fluent adherent used is water. At present, this is usually applied by way of a roller partially immersed in a bath of water, so that the periphery of the roller is wetted as the roller is rotated. To affix the flap of an envelope, the pre-glued flap surface is drawn across the wetted roller uppermost surface, and closure then is made. The wetting apparatus is clumsy, and liable to spillage.

The controlled application of glue in closely regulated fashion, within unmarked bounds, and on awkward areas such as the corners of sheets of paper or cardboard is difficult to achieve, and can readily lead to sticky hands and glue-contaminated surfaces that can then accumulate dirt, fluff and other undesireable detritus.

A great number of prior art handling and spreading devices exist, a sampling of which include the following listed U.S. Pat. Nos.: 807,887 Walker December 1905; 1,192,686 Rieger July 1916; 4,442,791 Adachi et al April 1984; 4,962,721 Peek October 1990; 5,012,758 Kunzler May 1991; 5,024,180 Roman June 1991; 5,078,527 Bell January 1992.

However, these prior art devices have not been adapted to meet the needs of a glue user. Also, they possess certain inherent characteristic drawbacks that make them unsuitable for some uses.

SUMMARY OF THE INVENTION

The present invention provides a glue applicator system to utilize a glue stick or other commercially available containerized applicator as a source of fluent adhering agent.

In the case of treating items such as envelopes that are pre-glued, the fluent adhering agent may be water, wherein the applicator will contain water.

As used herein in regard to the adhering agent the term "fluent" ranges from free flowing liquids to include substantially solid glue sticks in a plastic state, that may require the application of pressure in order to spread and adhere to the surface of a medium being glued.

The system thus includes mounting means for securing an applicator for a fluent adhering agent; guide means for providing relative guidance between the active end of the applicator and the surface of the medium, to which the adhering agent is to be applied; and supporting anvil means for locating a surface of the medium, to regulate contact pressure between the adhering agent and the opposed surface of the medium.

The invention may further comprise specialty components such as applicators with chisel-section nozzles, and may include flexible-tipped nozzles that can improve the accuracy of application. Such chisel-tip agent applicators generally possess one or more sharp corners to the nozzle, to enable precisely edged application of the nozzle and its contents to the medium surface. Suitable nozzle profiles include rectangular and triangular shapes. These are most helpful in applying the fluent agent to the corners of a sheet, such as a border extending about a corner of a sheet of paper or like medium.

It has been found that such nozzles, in course of use with liquid glues, may diminish or even make possible the avoidance of a residue of glue being left upon the nozzle tip.

The aforesaid guide means may include a support ball or roller as a positioning device such that the active end of the glue dispenser may be drawn in substantially consistent sliding, agent-applying relation along a face portion of the medium being treated.

The guide means may further include clamp means operable in relation to a working (medium) surface, to provide a linear path for traverse of the agent applicator therealong, while possibly also clamping the medium against slippage thereof induced by the tractive effort of the agent applicator therealong.

The adhering agent applicator, such as a glue stick, may be carried by mounting means that incorporate a lateral path adjustment capability whereby the path of contact of the active end of the applicator may be selectively controlled while under close visual reference. In the case of negotiating a non-straight line path, such as applying glue or other agent as a border around the corner of a sheet face, the lateral path adjustment means facilitates the traversing of the applicator about the 90 degree corner, where the sheet edges adjoin.

The path lateral adjustment means may comprise a laterally slidable support, wherein the user selectively displaces the agent applicator laterally upon its mounting means, while maintaining substantially constant the application of the adhering agent. The apparatus may be provided with cap retention means for conveniently storing the cap of the applicator. This is preferably of a type to receive the closure cap of the applicator in push-on stowed relation during use of the apparatus.

The applicator cap may contain moisture retention means, to maintain or restore the fluidity of the adhering agent when such is subject to drying-out. This moisture retention means may comprise a small sponge located within the cap, suited to the addition of a moisturizing liquid such as water.

In the case of the anvil means, these may comprise a variety of shapes and materials, depending in some measure on the characteristics of the medium to which the adhering agent is being applied.

Apparatus according to the present invention includes the provision of automatic cap removal means, whereby the removal and replacement of the closure cap, such as that of a glue stick, may be effected without making manual contact with the cap. This may include automatic stowage of the cap in isolated relation from the medium being treated.

The mounting means for securing the container of the agent may provide for downward or reversed (upward) dispensing of the agent.

The present invention makes practical the utilization of what would otherwise be scrap paper, as an adhered sheet, in substitution for the more expensive and less versatile hasty note, which is restricted to a limited range of sizes, and is generally a pressure sensitive, separable adhesive.

For school children, the making up of projects into book form becomes a ready and encouraging achievement that is greatly facilitated by the present invention.

A wide range of commercial applications is made possible.

BRIEF DESCRIPTION OF THE DRAWINGS

Certain embodiments of the invention are described by way of illustration, without limitation of the invention thereto, other than as defined by the present claims, reference being made to the accompanying drawings, wherein:

FIG. 8 is a perspective front elevation of an anvil embodiment;

FIG. 9 is a perspective side elevation of certain elements of the invention, showing the functional relationship therebetween;

FIG. 10 is a like view of two alternative anvil embodiments;

FIG. 11 is a perspective side view of an embodiment similar to that of FIG. 3, incorporating a sliding-wedge cap remover;

FIG. 12 is a perspective side view of a hand-held embodiment with a pivotable anvil combined with a cap-removal wedge;

FIG. 13 is a front perspective showing the use of a simple, hand-held inverted embodiment of an agent applicator;

FIG. 14 is a view similar to FIG. 13, for use of the FIG. 1 embodiment; and, FIG. 15 is a front perspective of apparatus having a moving beam applicator.

DETAILED DESCRIPTION OF THE EMBODIMENTS

Figure 1:
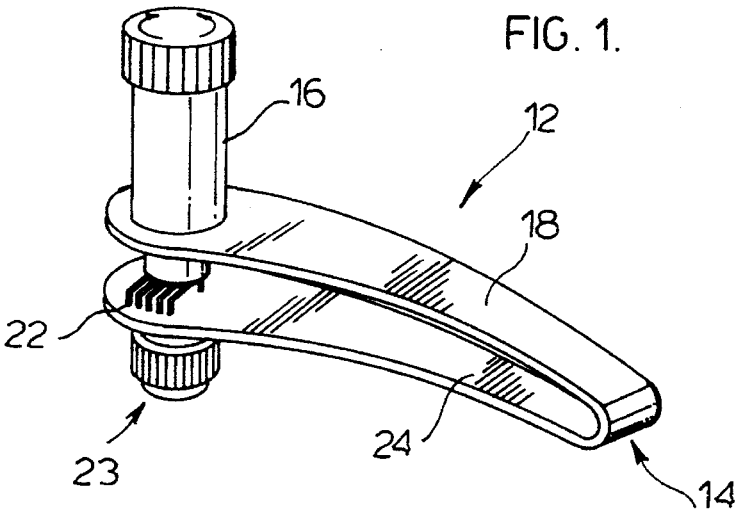
FIG. 1 is a perspective side view of a simple hand-held applicator embodiment.
Figure 2:
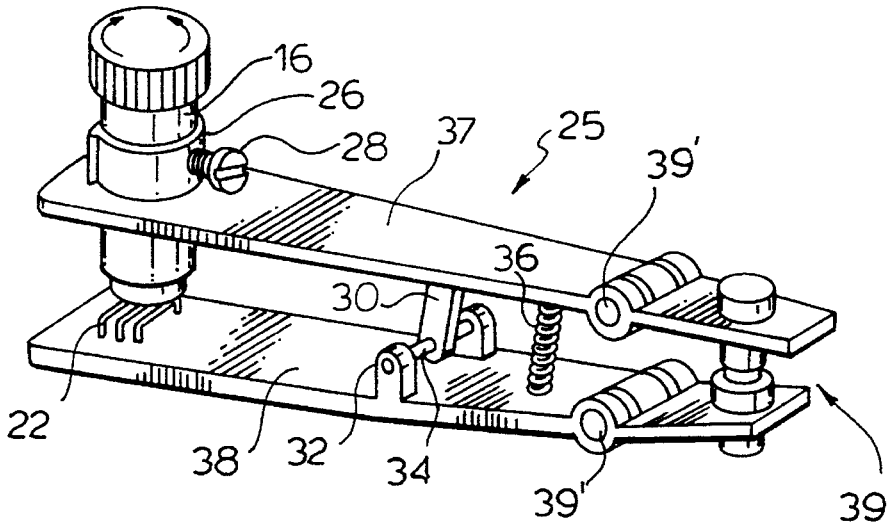
FIG. 2 is a view similar to FIG. 1 of an applicator with lateral adjustment characteristics.

Referring to FIG. 1, the tongs-type applicator 12 has a spring-steel or resilient plastic hand grip 14, having a glue-applicator 16 mounted upon the upper arm 18 of hand grip 14. A built-in anvil portion 22 is located at the front end of the lowermost arm 24 of grip 14. The length of the arms 18, 24 may be used so as to form a paper guide at the bight, where the arms 18, 24 join. The container closure cap 23 is shown press-fitted upon a cap-retainer pin (not shown). Referring to the Fig. 2 applicator 25, the adhering agent/glue container 16 is secured for downward application of the adhering agent by way of mounting ring 26 and grub screw 28. A built-in anvil 22 is shown.

A fulcrum arm portion 30 is slidably mounted on pivot rod 32, between centering springs 34. A return spring 36 serves to open the applicator 25.

The applicator main arms 37, 38 are pivotted about a vertical joint 39. Each arm 37, 38 has a transverse hinge 39', to lend flexibility to the arrangement.

In use, the applicator 25 may be located upon a supporting surface, and with the protective cap removed, a sheet of paper or other medium may be supported upon the anvil portion 22. The jointed construction of the arms 37, 38 permits the lower end of the applicator 25 to be depressed manually to contact the paper or other medium.

If required, lateral pressure may be applied so as to laterally traverse the lower end of the applicator, relative to the anvil 22, thus displacing the point of application of the affixing agent upon the medium. This traversing action facilitates the application of glue or other affixing agent around a corner border.

Figure 3:
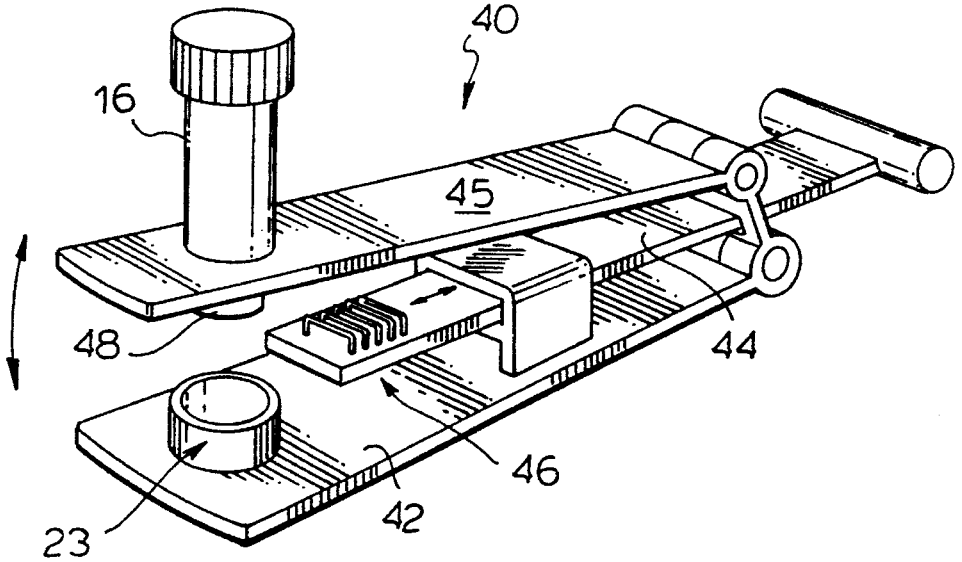
FIG. 3 is a perspective view of an embodiment with incorporated cap and retractable anvil.

The traversing displacement is resisted by the centering springs 34, which tend to center the fulcrum arm portion 30 upon rod 32. Referring to FIG. 3, the applicator 40 has a lower arm 42 to which the applicator cap 23 may be secured, and hinged under arm 45.

A slideable anvil arm 44 enables the anvil 46 to be relocated in supported relation upon the cap 23, directly beneath the output end 48 of the applicator housing container 16. In use, the cap 23 is first removed by pivoting the upper arm 45 upwardly. The anvil 46 may then be slid forward into its operative position over the cap 23, and the medium to be glued then positioned between the anvil 46 and applicator head 48. Manual pressure to compress the upper arm 45 and lower arm 42, with coordinated traverse of the medium then results in the application of the adhesion agent to the medium, as desired.

Figure 3A:
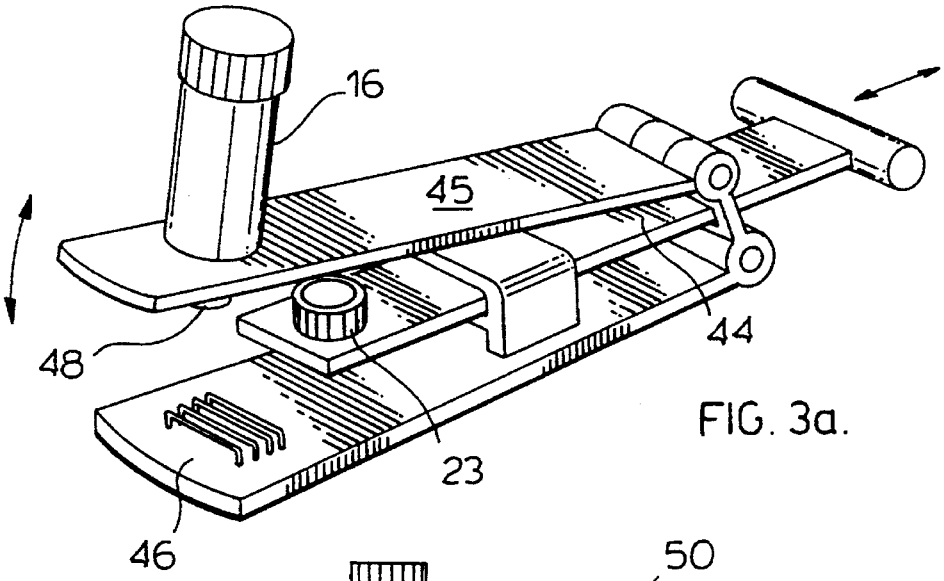
FIG. 3*a* is a view similar to FIG. 3 of a like embodiment, with an incorporated anvil and retractable cap.

Turning to FIG. 3*a*, it will be seen that the relative positions of the anvil 46 and cap 23 are reversed. In use, the cap is again removed from its protecting relation by upward pivotal deflection of the top arm 45. The cap 23 may then be retracted by rightward withdrawal movement of the arm 44, to expose the anvil 46. The medium to be glued may then be inserted between the anvil 46 and the applicator head 48, and the adhesion agent applied.

Figure 4:
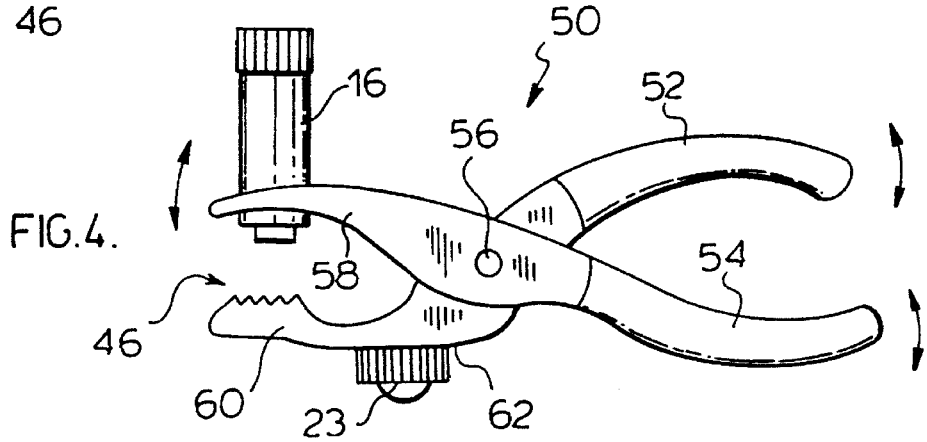
FIG. 4 is a side view of a pliers-type, hand-held embodiment.

Referring to FIG. 4, this scissors or plier type embodiment 50 has a pair of handles 52, 54 that are pivoted at 56. One jaw 58 carries the agent applicator 16. The other jaw 60 carries the anvil 46.

The cap 23 is shown mounted upon a cap holder portion 62 of the lower jaw 60. Location of the medium between the anvil 46 and the applicator head 48, and manipulation thereof while compressing the handles 52, 54 results in the application of the adhesion agent as desired.

Figure 5:
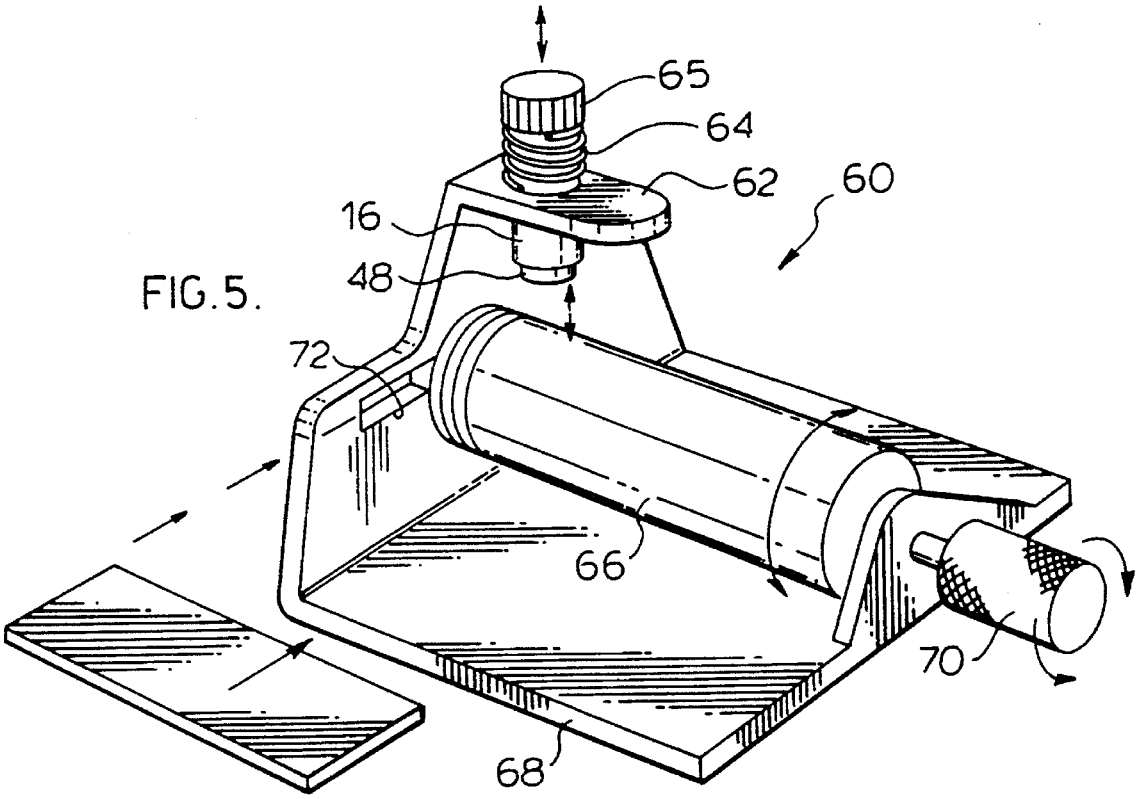
FIG. 5 is a desk-top embodiment with sheet roll-feed, shown in perspective.

Referring to FIG. 5 a desk-top embodiment 60 has a supporting bridge portion 62 by which is supported the agent applicator 16, in retractable holder 64, illustrated as being spring-loaded or threaded, having an end cap 65. A resilient-faced roller 66 is rotatably supported by its ends in frame portion 68, to serve as a dynamic anvil. A handle portion 70 may be provided to rotate the roller 66.

A medium guide 72 in aligned relation with the top of roller 66 serves to guide the medium between the roller 66 and the head 48 of the applicator 16. Downward adjustment of the applicator 16 can then provide the desired pressure of agent to the surface of the medium. Oscillation of the roller 66 can be used to intensify the extent of application of the adhesion agent, as in the case of certain surfaces that do not readily accept such application.

Figure 6:
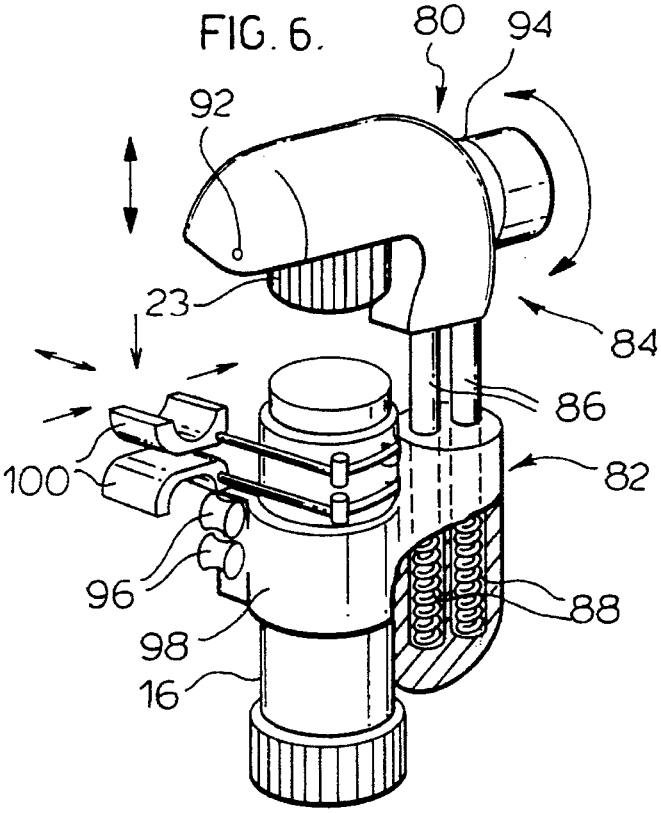
FIG. 6 is a perspective side view of an inverted applicator with tiltable anvil embodiment.
Figure 6A:
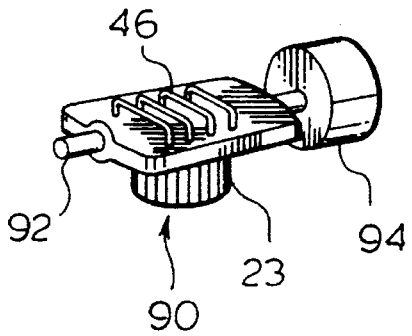
FIG. 6*a* is a detail perspective of the cap/anvil of FIG. 6.

Turning to FIG. 6, a hand-held embodiment 80 has a lower body portion 82 with an upper body portion 84 supported thereon by a pair of spring loaded sliding rods 86. The springs 88 are recessed in the lower body 82, and serve to extend the rods 86. The upper body portion 84 is hollow, and houses a reversible cap/anvil combination 90, shown in FIG. 6*a*. The cap/anvil 90 is rotatably supported on shaft 92, having a knob 94 by which an anvil portion 46 or cap 23 may be selectively positioned in a downwardly facing direction. A container 16 for the fluent agent is adjustably mounted in the lower body portion 82, having adjustment screws 96 by which the bracket halves 98 may be selectively adjusted.

A pair of mutually opposed sheet guides 100 are resiliently secured to the lower body portion 82, for guiding a sheet of medium across the head portion of the agent container 16. With the cap 23 removed from the container 16, and the anvil portion 46 projecting downwardly, the user can conveniently depress the upper body portion 84 to bring the anvil portion 46 into downward bearing relation on the upper face of the medium (not shown). Using the other hand to displace the medium across the face of the affixing agent, the desired coating of agent may thus be readily applied.

Figure 7:
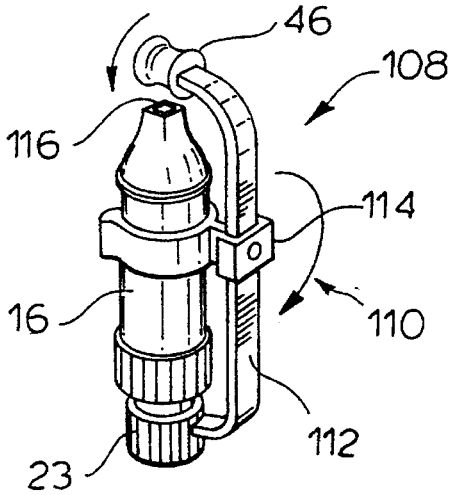
FIG. 7 is a side perspective view of an inverted embodiment with wedge dispenser nozzle and flexible anvil mount.

The FIG. 7 embodiment 108 comprises a U-shaped clip 110 having an arm 112 pivotally and slidably secured thereto at 114.

An anvil 46 is secured to one end of the arm 112, and a cap 23 is secured to the other end of arm 112.

In the illustrated position the sheet of medium being treated may be located between the anvil 46 and the adjacent nozzle 116 of the dispenser 16. Finger pressure on the arm 112 can then bend the arm 112 to press the anvil 46 against the medium (not shown) thereby bringing it into compressed relation across the face of the nozzle 116.

Figure 7A:
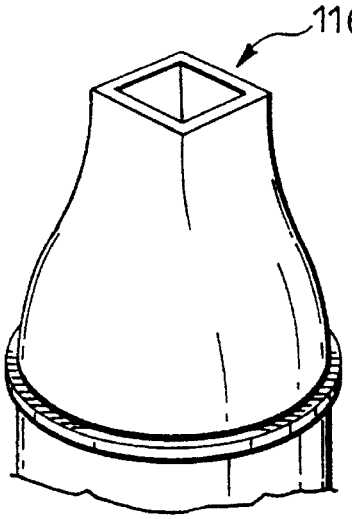
FIG. 7*a* is an enlarged portion of FIG. 7.

The nozzle 116 is illustrated in FIG. 7*a* as being of reduced square section, the corners of which may be sharp and flexible. It will be evident that other preferred shapes therefor may be adopted. Pivotal reversal of the arm 112 brings the cap 23 into a position for application thereof in sealing relation with the dispenser 16. FIG. 8 shows an anvil 23 having a square face 120 and a threaded support shaft 122.

FIG. 9 shows relative positions of an anvil 23, an insertable sheet of medium 124 and the output head 126 of an applicator.

FIG. 10 shows two alternative other embodiments of anvil 23, also having stationary contact faces, being of the removable insert type, to facilitate cleaning or for changing the anvil to accommodate to the application characteristics of differing media or adhesives and which may be substituted for the other illustrated like forms of anvil.

Referring to FIG. 11, this embodiment is akin to the FIG. 3 embodiment, with the addition of an automatic cap remover 130. Thus, the slideable arm 44 having an anvil 46 mounted on the outer end thereof includes a double sided wedge portion 132 that comprises a part of the cap remover 130. A pair of wedge-ramp portions 134,136, respectively located on arms 42 and 45 cooperate with the wedge portion 132, upon forward sliding displacement of the arm 44, serving as a cam means so as to pull the cap 23 from off the end 48 of dispenser 16. It will be understood that the cap 23 is a sealing press-fit upon the end 48 of the dispenser 16.

Turning to FIG. 12, the application 140 is a simple, hand held device, akin to the FIG. 1 embodiment. However, the cap 23 forms a part of the lower arm 142, and is a press-fit onto the end 48 of the dispenser 16. The upper arm 144 has a laterally extending wedge-ramp portion 146, of which the thin end is visible in the drawing.

Pivotally secured at 148 to the lower arm 142 is a combined anvil-wedge 152, having a wedge portion 154 and an anvil portion 156. Initial pivotal displacement inwardly from the position shown, brings the wedge portions 146,154 into sliding, wedging relation, serving as a cam means to force the cap portion 23 from off the end 48 of dispenser 16. A further rotation brings the anvil portion 156 into registry with dispenser outlet 48, so the medium to be coated can be introduced therebetween. Manual compression of the upper and lower arms 142,144 in coordinated relation with travelling displacement of the medium then permits controlled application of the fluent agent across the selected portion of the medium.

Referring to FIG. 13, this shows the manner of use of an embodiment in accordance with FIG. 7, with the dispenser 108 held by the user in one hand, the user's thumb compressing the anvil 46 downwardly so as to hold the medium, illustrated as a card 160 in downward pressing relation on the dispenser nozzle 116. Similarly, in FIG. 14, the FIG. 1 embodiment 12 is illustrated in the user's hand, held under controlled compression relative to the card-medium 160, to apply a border 162 of adherant agent.

It will be evident that the other illustrated hand-held embodiments may be similarly used.

Turning to FIG. 15, a desk-top or table-top embodiment 170 has a guide rail 172 pivotally secured at 174 to a slider 176, the slider 176 being laterally moveable along groove 178 of base 180. The guide rail 172 may have a resilient face, such as a stiff rubber or elastomer, to grip a media such as paper when an adhesive is being applied, while also serving as a guide to the applicator when longitudinal applications of agent are made. A shallow anvil 182 also is illustrated, along the side of the board. It will be seen that this embodiment facilitates guided rectilinear displacement of the glue dispenser 16 over the medium card 160. Movement along the X and Y coordinate axes is particularly facilitated. The dispenser 16 is shown as having a cap 23 thereof pivotally mounted upon the board 180.

What I claim by Letters Patent of the United States is:

1. Dispensing apparatus for dispensing an adherent agent in applied relation to the surface of a medium, comprising: dispenser mounting means to receive a dispenser of adherent agent in secured relation therewith; an adherent agent dispenser secured thereto, having an output end portion with a removable sealing cap; said apparatus including anvil means positionable in opposed, spaced relation with said dispenser mounting means to receive said medium in interposed relation between said dispenser output end portion and said anvil means, in supported relation with said anvil means, the output end portion of the agent dispenser being displaceable, in use, into adherent applying relation with said supported medium, to apply said adherent agent thereto.

2. The apparatus as set forth in claim 1, including cap mounting means disposed on said apparatus for securing said cap in attached relation thereto.

3. The apparatus as set forth in claim 1, said dispenser mounting means including a tongs handle portion having a pair of arms in bifurcated relation; said dispenser being mounted at the distal end of one said arm, having said output end portion projecting towards the other said arm; said anvil means being located upon said other arm, opposite said output end portion and spaced therefrom, to receive said medium in inserted relation therebetween.

4. The apparatus as set forth in claim 3, including a cap retaining means located on one of said arms in spaced relation from said dispenser and said anvil means, to receive said dispenser cap in secured relation therewith.

5. The apparatus as set forth in claim 1, said dispenser mounting means including a pair of arms pivoted together substantially at one end remote from said dispenser, a fulcrum arm extending between said arms, intermediate the ends thereof and secured to one said arm in laterally movable relation therewith, to permit lateral displacement of said dispenser relative to said anvil means; and hinge means on at least one said arm, to permit movement of said dispenser towards and away from said anvil means.

6. The apparatus as set forth in claim 5, each said arm having a said hinge means; and spring means for resiliently biassing said arms in spaced apart relation, to facilitate the insertion of said medium between said dispenser output end and said anvil means.

7. The apparatus as set forth in claim 1, said dispenser mounting means having a pair of arms in mutually displaceable relation, with one arm of said pair supporting said dispenser, and the other arm of said pair supporting said cap, the apparatus having said anvil means mounted upon a third arm slideably displaceable between said pair of arms, being located in mutually spaced, substantially parallel relation therewith, and handle means disposed on said third arm for sliding said anvil means in opposed, adjacent relation with said dispenser outlet end portion when said outlet end portion and said cap are in spaced apart relation.

8. The apparatus as set forth in claim 1, having said cap mounted upon a third arm slideably displaceable between a pair of arms located in mutually spaced, substantially parallel relation therewith, and handle means disposed on said third arm for sliding said cap between said anvil and said dispenser outlet end portion, to permit application of the cap to the dispenser outlet end portion.

9. The apparatus as set forth in claim 1, having a pair of scissor arms secured in pivotal relation intermediate their ends, and having said dispenser outlet end portion in facing relation with said anvil means such that displacement of said arms in mutual closing relation brings said dispenser outlet in closing relation with said anvil means, in use to compress said medium therebetween.

10. The apparatus as set forth in claim 1, said anvil means being removable, to facilitate cleaning thereof, the anvil means including a replaceable contact face portion in accomodation to a medium made of different materials.

11. The apparatus as set forth in claim 1, said anvil means comprising a roller having said dispenser outlet end disposed adjacent thereto for relative displacement towards and away from said roller; and guide means disposed adjacent said dispenser outlet end portion and one end of said roller for guiding said medium by an edge thereof between said roller and said dispenser outlet end.

12. The apparatus as set forth in claim 1, said anvil means and said dispenser cap being mounted upon opposed sides of a rotatable arm and disposed in opposed relation with said dispenser outlet end, said rotatable arm being connected with said dispenser mounting means by way of slide means, for guiding said rotatable arm toward and away from said dispenser outlet end in use to enable the application of said cap in sealing relation with said dispenser outlet end, and alternatively to enable the removal of said cap and the location of said anvil means in medium supporting relation adjacent said dispenser outlet end.

13. The apparatus as set forth in claim 1, having said anvil means located at one end of a pivotal arm, with said cap located at the other end of said pivotal arm, and pivot means disposed along said dispenser intermediate the ends of said pivotal arm permitting selective repositioning of said arm to locate said anvil in adjacent, substantially aligned relation with said dispenser output end portion and said cap in positioned, aligned engaging relation with said dispenser outlet end portion.

14. The apparatus as set forth in claim 1, said dispenser outlet end portion having at least one edge of predetermined shape, to facilitate the application of said adherent agent to said medium.

15. The apparatus as set forth in claim 14, said dispenser outlet end portion being flexible, said predetermined shape including sharp corners.

16. The apparatus as set forth in claim 1, said anvil means including a platform portion mounted upon attachment means removably secured to said dispenser mounting means, said platform portion having a plurality of raised prominences arranged in mutually coplanar relation to provide a localized supporting platform for said medium.

17. The apparatus as set forth in claim 7, said third arm having first cam means extending therefrom towards the adjacent other pair of arms, said other arms each having second cam means extending towards said third arm in cooperating relation with said first cam means, whereby, upon sliding displacement of said third arm towards said dispenser said first and second cam means interact with each other in mutual wedging relation to force said pair of arms apart, thereby displacing said cap from said dispenser, to enable location of said anvil means in interposed relation between said cap and said dispenser outlet end portion.

18. The apparatus as set forth in claim 3, including cam means pivotally secured to said tongs handle portion, moveable in use from a first, retracted position to a second position in inserted relation between said pair of arms to force said arms apart, to thereby uncap said dispenser; and movable to a third position to insert said anvil means in interposed relation between said outlet end portion and said cap.

19. The apparatus as set forth in claim 1, said dispenser mounting means having said cap attached thereto; said mounting means being resiliently deformable to permit removal and replacement of said cap on said outlet end portion; said anvil means being carried by said mounting means and movable into aligned, spaced relation with said outlet end portion when said cap is removed therefrom, to permit the introduction of said medium between said anvil and said outlet end portion, said dispenser mounting means being manually deformable to permit the manual pressing of said medium by said anvil towards said outlet end portion, to facilitate the controlled application of said agent to said medium.

20. The apparatus as set forth in claim 1, including a planar base having a lateral groove thereacross; a slider mounted within said groove, for lateral displacement along the groove; a guide beam pivotally secured to the slider and extending across the surface of said planar base; said anvil means extending along an edge of the base, substantially parallel with the axis of said guide beam; said dispenser being movable in sliding relation with and along said beam, to facilitate the movement of said dispenser outlet across the face of said base, including linear displacement along X and Y coordinates.

* * * * *